US011393380B2

(12) United States Patent
Kim et al.

(10) Patent No.: US 11,393,380 B2
(45) Date of Patent: Jul. 19, 2022

(54) INTEGRATED CIRCUIT, METHOD FOR OPERATING THE SAME, AND DISPLAY SYSTEM INCLUDING THE SAME

(71) Applicant: LX SEMICON CO., LTD., Daejeon (KR)

(72) Inventors: Bo Sung Kim, Daejeon (KR); Byung Woo Song, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/544,487

(22) Filed: Dec. 7, 2021

(65) Prior Publication Data

US 2022/0189369 A1 Jun. 16, 2022

(30) Foreign Application Priority Data

Dec. 10, 2020 (KR) ..... 10-2020-0171949

(51) Int. Cl.
*G09G 3/20* (2006.01)

(52) U.S. Cl.
CPC ..... *G09G 3/20* (2013.01); *G09G 2310/0275* (2013.01); *G09G 2310/08* (2013.01); *G09G 2340/0435* (2013.01)

(58) Field of Classification Search
CPC ..... G09G 3/20; G09G 2310/0275; G09G 2310/08; G09G 2340/0435
See application file for complete search history.

(56) References Cited

U.S. PATENT DOCUMENTS

2020/0143756 A1 5/2020 Chen
2021/0049746 A1* 2/2021 Peana ..... G06T 5/008
2021/0049978 A1* 2/2021 Shih ..... G09G 3/32

FOREIGN PATENT DOCUMENTS

KR 10-1732468 B1 5/2017
KR 10-2018-0056458 A 5/2018

* cited by examiner

*Primary Examiner* — Sejoon Ahn
(74) *Attorney, Agent, or Firm* — Harness, Dickey & Pierce, P.L.C.

(57) ABSTRACT

Provided is an integrated circuit capable of gating a clock signal to reduce power consumption during a vertical front porch interval, the integrated circuit including: a control signal generator configured to change a gating control signal from a low level to a high level according to a timing when a data enable signal changes from the high level to the low level, and change the gating control signal from the high level to the low level after a predetermined horizontal back porch interval from a rising edge of a horizontal synchronization signal; and a clock gating circuit configured to stop toggling of a first clock signal input through a first input terminal to output a second clock signal maintained at the low level through a first output terminal when the gating control signal of the high level is input to a control terminal.

19 Claims, 3 Drawing Sheets

INTEGRATED CIRCUIT, METHOD FOR OPERATING THE SAME, AND DISPLAY SYSTEM INCLUDING THE SAME

CROSS-REFERENCE TO RELATED APPLICATIONS

This application claims the benefit of the Korean Patent Application No. 10-2020-0171949 filed on Dec. 10, 2020, which is hereby incorporated by reference as if fully set forth herein.

FIELD OF THE INVENTION

The present disclosure relates to controlling a clock signal of a display, and more particularly, to gating a clock signal.

BACKGROUND

Use of display devices capable of supporting both a first frame rate (e.g., 60 Hz) and a second frame rate (e.g., 120 Hz) and being operated at the first frame rate or the second frame rate is increasing.

In the case of such a display device, for a very smooth and seamless frequency change, it is possible to drive the display device at the first frame rate and the second frame rate by synchronizing a one-cycle vertical synchronization time of the first frame rate and a one-cycle vertical synchronization time of the second frame rate with each other and increasing a vertical porch interval of a vertical synchronization signal corresponding to the first frame rate.

However, when the vertical porch interval of the vertical synchronization signal is long during the driving of the display device at the first frame rate, a clock signal may toggle during the vertical porch interval and thus power consumption of circuits operating using the clock signal increases.

SUMMARY

To address the above problem, the present disclosure is directed to providing an integrated circuit capable of gating a clock signal to reduce power consumption during a vertical front porch interval, an operation method of the integrated circuit, and a display system including the integrated circuit.

According to an aspect of the present disclosure, an integrated circuit for gating a clock signal includes: a control signal generator configured to change a gating control signal from a low level to a high level according to a timing when a data enable signal changes from the high level to the low level, and change the gating control signal from the high level to the low level after a predetermined horizontal back porch interval from a rising edge of a horizontal synchronization signal; and a clock gating circuit configured to stop toggling of a first clock signal input through a first input terminal to output a second clock signal maintained at the low level through a first output terminal when the gating control signal of the high level is input to a control terminal, and resume the toggling of the first clock signal to output the second clock signal, which toggles between the high level and the low level, through the first output terminal when the gating control signal of the low level is input to the control terminal.

According to another aspect of the present disclosure, a display system includes a display device and a driver integrated circuit (IC) configured to control an operation of the display device, wherein the driver IC includes: a control signal generator configured to change a gating control signal from a low level to a high level according to a timing when a data enable signal changes from the high level to the low level, and change the gating control signal from the high level to the low level after a predetermined horizontal back porch interval from a rising edge of a horizontal synchronization signal; and a clock gating circuit configured to stop toggling of a first clock signal input through a first input terminal to output a second clock signal maintained at the low level through a first output terminal when the gating control signal of the high level is input to a control terminal, and resume the toggling of the first clock signal to output the second clock signal, which toggles between the high level and the low level, through the first output terminal when the gating control signal of the low level is input to the control terminal.

According to another aspect of the present disclosure, an operation method of an integrated circuit for gating a clock signal includes: changing a gating control signal from a low level to a high level when a data enable signal changes from the high level to the low level; stopping toggling of a first clock signal input through a first input terminal to output a second clock signal maintained at the low level to a first output terminal in response to the gating control signal of the high level; changing the gating control signal from the high level to the low level after a predetermined horizontal back porch interval from a rising edge of a horizontal synchronization signal; and resuming the toggling of the first clock signal to output the second clock signal, which toggles between the high level and the low level, to the first output terminal in response to the gating control signal of the low level.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE INVENTION

Figure 1:
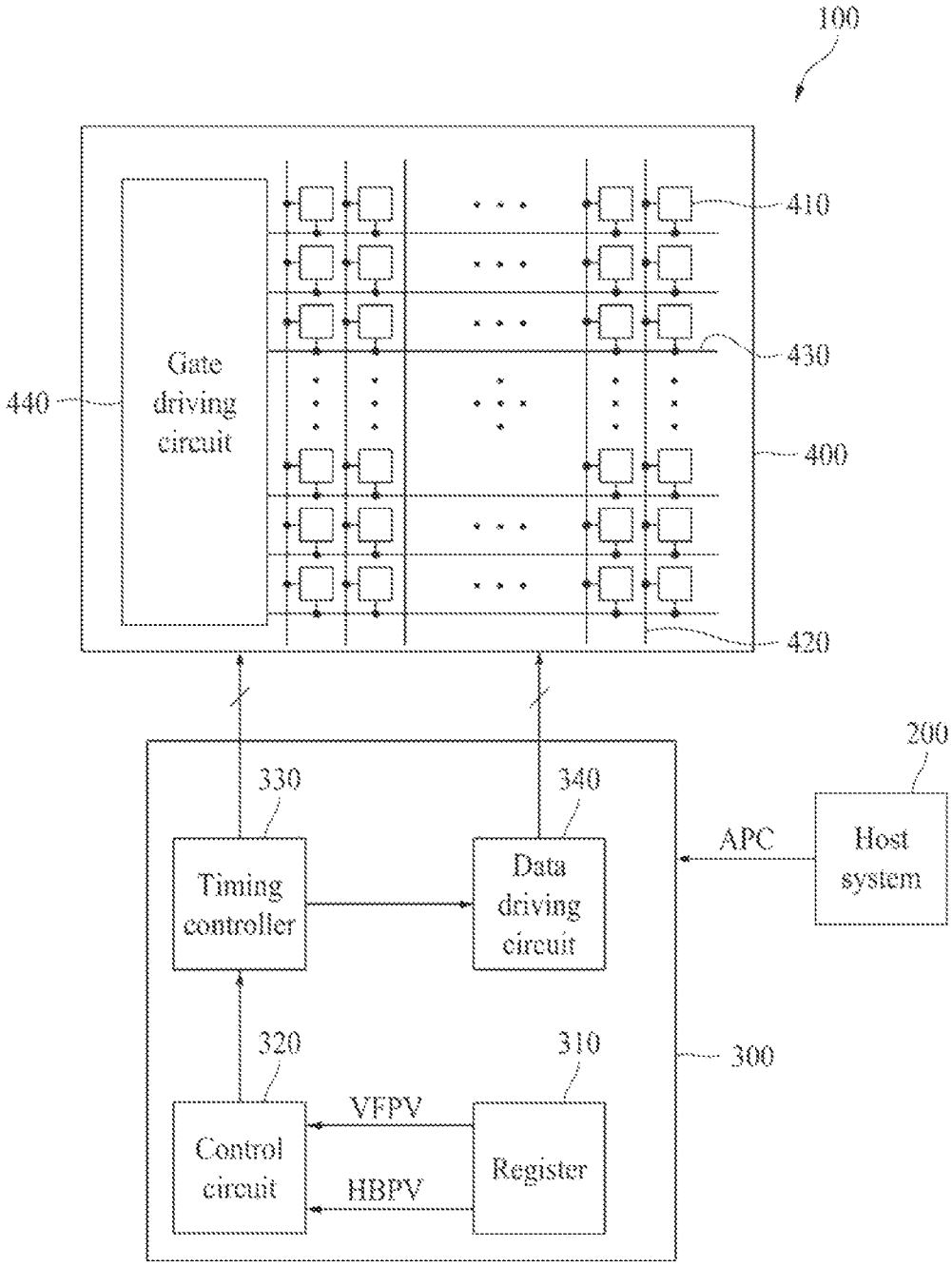
FIG. 1 is a block diagram of a display system according to an embodiment of the present disclosure.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein.

Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of this specification will be described in detail with reference to the accompanying drawings.

FIG. 1 is a block diagram of a display system according to an embodiment of the present disclosure.

As shown in FIG. 1, a display system 100 according to an embodiment of the present disclosure includes a host system 200, a driver integrated circuit (IC) 300, and a display device 400.

The display system 100 may be an electronic device including the display device 400, for example, a mobile device using a voltage of a battery as an operating voltage.

Examples of the mobile devices may include at least one of a laptop computer, a mobile Internet device (MID), an Internet-of-Things (IoT) device, a tablet PC, and a smartphone.

The host system 200 may be a control device capable of controlling an operation of the driver IC 300 and may be, but is not limited to, a central processing unit (CPU) or an application processor (AP). The host system 200 generates a command APC indicating whether to operate the display device 400 at a first frame rate (e.g., 60 Hz) or a second frame rate (e.g., 120 Hz) and transmit the command APC to the driver IC 300.

The host system 200 may determine whether an application program executed in the display system 100 is a game application program or an application program capable of scrolling a web page (or a web document, hereinafter referred to as a "web document").

When it is determined that the game application is not being executed or the web document is not being scrolled, the host system 200 generates a command APC instructing to operate the display device 400 at the first frame rate. When it is determined that the game application is being executed or the web document is being scrolled, the host system 200 generates a command APC instructing to operate the display device 400 at the second frame rate.

The command APC includes at least one of a first value HBPV indicating a horizontal back porch interval HBP of a horizontal synchronization signal Hsync and a second value VFPV indicating a vertical front porch interval VFP of a vertical synchronization signal Vsync with respect to each frame rate.

In an embodiment, at least one of the first value HBPV and the second value VFPV for each frame rate may be stored or programmed in a register 310. That is, the command APC includes at least one of the first value HBPV and the second value VFPV for the first frame rate or at least one of the first value HBPV and the second value VFPV for the second frame rate.

In an embodiment, the first value HBPV and the second value VFPV may be set differently according to a frame rate. For example, the second value VFPV of the first frame rate (e.g., 60 Hz) may be set to be greater than the second value VFPV of the second frame rate (e.g., 120 Hz).

The driver IC 300 for controlling an operation of the display device 400 includes the register 310, a control circuit 320, a timing controller 330, and a data driving circuit 340.

The control circuit 320 determines a toggling timing and a toggling stop timing of a first clock signal CLK1 in response to control signals. The control circuit 320 may output the first clock signal CLK1 as a second clock signal CLK2 by stopping or resuming toggling of the first clock signal CLK1.

The control circuit 320 generates a gating control signal on the basis of at least one of a horizontal synchronization signal, a first value HBPV indicating a horizontal back porch interval HBP of the horizontal synchronization signal, a second value VFPV indicating a vertical front porch interval VFP of a vertical synchronization signal, and a data enable signal. The control circuit 320 determines a toggling timing and a toggling stop timing of the first clock signal CLK1 in response to the gating control signal.

The timing controller 330 controls operations of the data driving circuit 340 and a gate driving circuit 440 according to a timing signal. In particular, the timing controller 330 according to the present disclosure may transmit signals for driving the display device 400 to the display device 400 through the data driving circuit 340 according to a second clock signal CLK2 supplied from the control circuit 320 or transmit the signals to the gate driving circuit 440 according to the first clock signal CLK1.

In an embodiment, the timing controller 330 may generate a data timing control signal for controlling an operation of the data driving circuit 340 or a gate timing control signal for controlling an operation of the gate driving circuit 440 from timing signals, including a vertical synchronization signal Vsync, a horizontal synchronization signal Hsync, the clock signals CLK1 and CLK2, a data enable signal DE, and the like.

The data timing clock signal may include a source start pulse (SSP), a source sampling clock (SSC), a source output enable signal, etc., and the gate timing control signal may include a gate start pulse (GSP), a gate shift clock (GSC), a gate output enable signal, etc.

The data driving circuit 340 supplies data DATA input from the timing controller 330 to each of pixels 410 of the display device 400 through data lines 420 according to the second clock signal CLK2 and the data timing clock signal.

Although not shown in FIG. 1, to this end, the data driving circuit 340 may include components such as a digital processor, an analog processor, and the like.

The display device 400 may be a flat panel display device capable of performing a display function and a touch sensing function. Examples of the flat panel display device include a liquid crystal display (LCD) and an organic light-emitting diode (OLED) display.

The display device 400 includes the pixels 410, the data lines 420, and gate lines 430, and each of the pixels 410 is connected to one of the data lines 420 and one of the gate lines 430. The display device 400 may include the gate driving circuit 440. In this case, the display device 400 may be a display panel having a touch function (also referred to as a "touch screen panel"), and each of the pixels 410 may be a pixel including an OLED.

The data lines 420 supply data voltages applied from the driver IC 300 to the pixels 410. The gate lines 430 supply gate signals supplied from the gate driving circuit 440 to the pixels 410.

Figure 2:
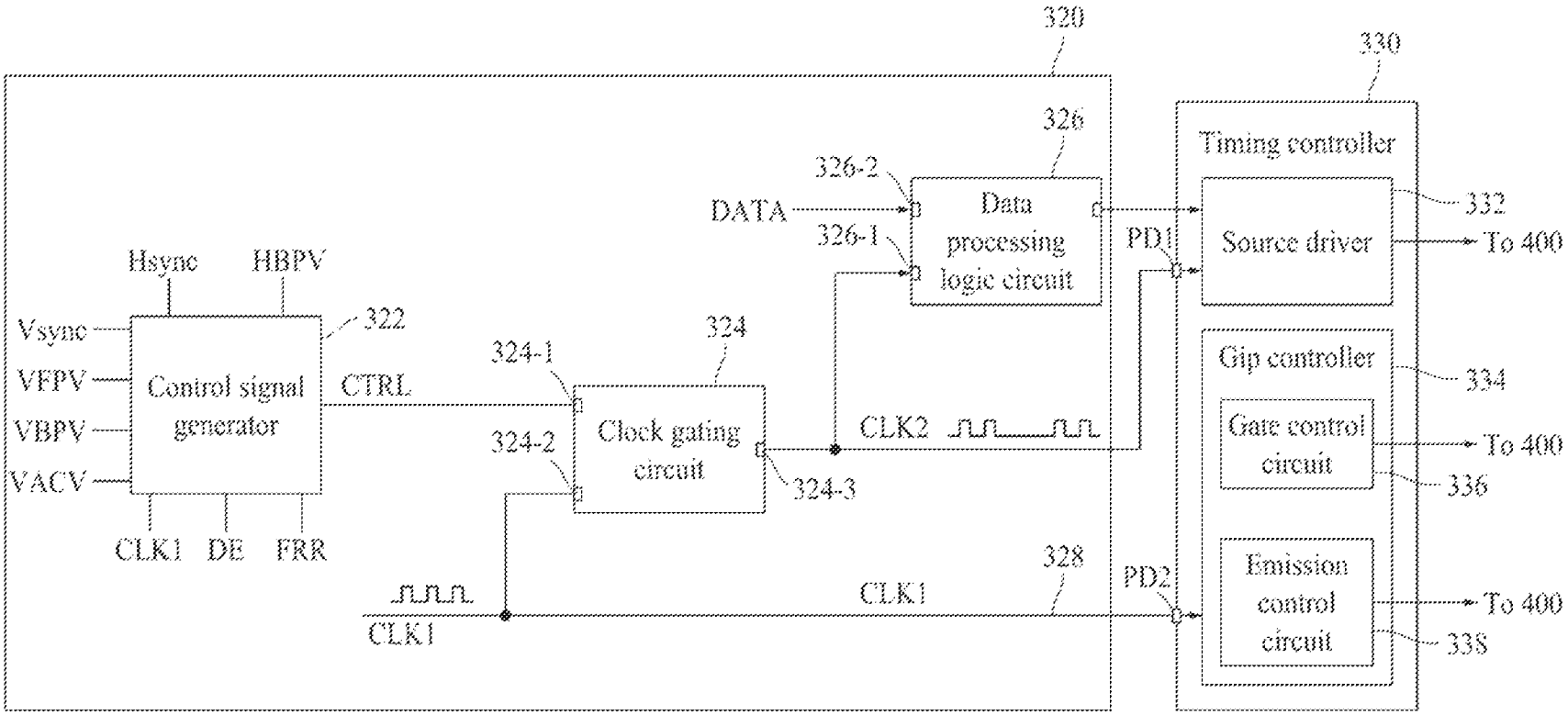
FIG. 2 is a block diagram of a control circuit and a timing controller that are included in a driver integrated circuit (IC) according to an embodiment of the present disclosure.
Figure 3:
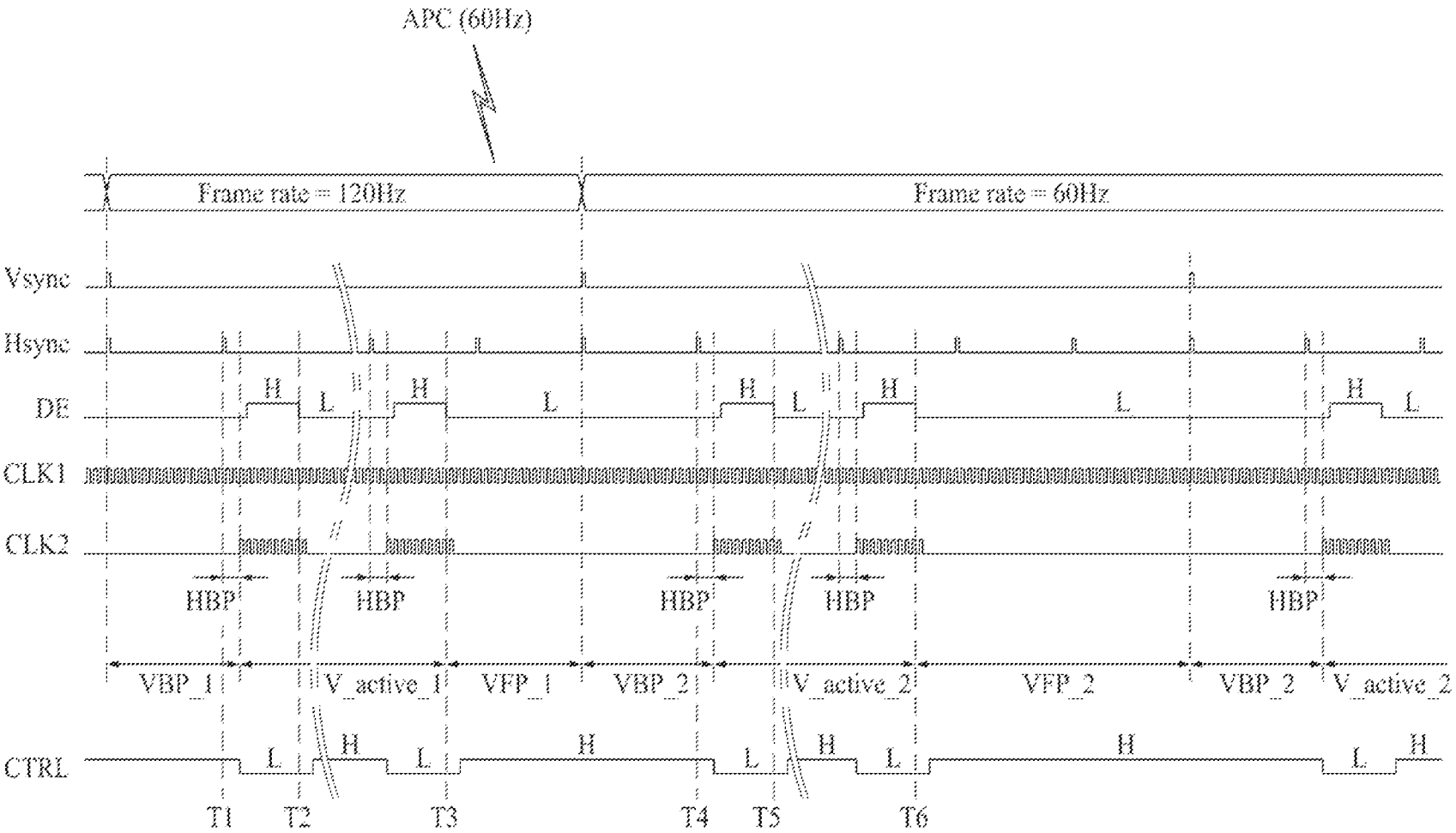
FIG. 3 is a timing diagram for describing an operation of a driver IC according to an embodiment of the present disclosure.

FIG. 2 is a block diagram of a control circuit and a timing controller that are included in a driver IC according to an embodiment of the present disclosure, and FIG. 3 is a timing diagram for describing an operation of the driver IC according to an embodiment of the present disclosure.

Referring to FIG. 2, a control circuit 320 for controlling supply of a clock signal includes a control signal generator 322 and a clock gating circuit 324. Although FIG. 2 illustrates for convenience of description that the control circuit 320 includes a data processing logic circuit 326, the data processing logic circuit 326 may be provided outside the control circuit 320.

The control signal generator 322 receives a first clock signal CLK1, a horizontal synchronization signal Hsync, a data enable signal DE, a first value HBPV indicating a horizontal back porch interval HBP of the horizontal synchronization signal Hsync, and a second value VFPV indicating vertical front porch interval VFP of a vertical synchronization signal Vsync.

In an embodiment, the control signal generator 322 may additionally receive frame rate information FRR about a frame rate of the display device 400.

The control signal generator 322 generates a gating control signal CTRL changing to a high level or a low level on the basis of at least one of the horizontal synchronization signal Hsync, the data enable signal DE, the first value HBPV, and the second value VFPV.

In an embodiment, when a rising edge of the horizontal synchronization signal Hsync is detected, the control signal generator 322 changes the gating control signal CTRL from the high level to the low level at a timing after the horizontal back porch interval HBP corresponding to the first value HBPV from the rising edge.

In this case, the control signal generator 322 may change the gating control signal CTRL to the low level from the high level before the data enable signal DE changes from the low level to the high level. This is to prevent a first piece of data of the data enable signal DE from not being processed when toggling of the second clock signal CLK2 resumes after the data enable signal DE changes to the high level.

Thereafter, the control signal generator 322 changes the gating control signal CTLR from the low level to the high level when changing of the data enable signal DE from the high level to the low level is detected.

In this case, the control signal generator 322 may change the gating control signal CTRL from the low level to the high level a certain time after the data enable signal DE changes from the high level to the low level (e.g., after a first clock signal CLK1 or a second clock signal CLK2 is toggled again for a period time). This is to secure a data processing margin.

When a last data enable signal DE among data enable signals DE included in one frame is detected, the control signal generator 322 may maintain the gating control signal CTRL at the high level during the vertical front porch interval VFP of the vertical synchronization signal after the last data enable signal DE changes from the high level to the low level (or after a certain time elapses after the last data enable signal DE changes from the high level to the low level).

In this case, in order to detect the last data enable signal DE among the data enable signals DE included in the one frame, the control signal generator 322 may additionally receive the vertical synchronization signal Vsync, a third value VBPV indicating a vertical back porch interval VBP of the vertical synchronization signal Vsync, and a fourth value VACV indicating a vertical active interval V_active of the vertical synchronization signal Vsync. In this case, the control signal generator 322 may determine a point in time after the sum of the third value VBPV and the fourth value VACV is counted after a rising edge of the vertical synchronization signal Vsync is detected as a point in time when the last data enable signal DE in the corresponding frame changes from the high level to the low level, i.e., a point in time when the last data enable signal DE ends.

The clock gating circuit 324 includes a control terminal 324-1, a first input terminal 324-2, and a first output terminal 324-3. In response to the gating control signal CTRL input to the control terminal 324-1, the clock gating circuit 324 determines whether to stop or resume toggling of a first clock signal CLK1 input to the first input terminal 324-1. The clock gating circuit 324 may output the first clock signal CLK1 as a second clock signal CLK2 through the first output terminal 324-3 by stopping or resuming the toggling of the first clock signal CLK1.

Specifically, the clock gating circuit 324 determines to stop the toggling of the first clock signal CLK1 and outputs the second clock signal CLK2 maintained at the low level when a high-level gating control signal is input to the control terminal 324-1. The clock gating circuit 324 determines to resume the toggling of the first clock signal CLK1 and outputs a second clock signal CLK2 toggling between the high level and the low level when a low-level gating control signal is input to the control terminal 324-1.

Operations of the control signal generator 322 and the clock gating circuit 324 described above with reference to FIG. 3 will be described with examples below.

When a rising edge of the horizontal synchronization signal Hsync is detected at a first point in time T1 or a fourth point in time T4, the control signal generator 322 changes the gating control signal CTRL from the high level to the low level at a timing after the horizontal back porch interval HBP corresponding to the first value HBPV from the rising edge. In this case, the first value may be set differently according to a first frame rate or a second frame rate.

In an embodiment, when a rising edge of the horizontal synchronization signal Hsync is detected, the control signal generator 322 according to the present disclosure may change the gating control signal CTRL from the high level to the low level after the horizontal back porch interval HBP corresponding to the first value HBPV elapses and before the data enable signal DE changes from the low level to the high level.

For example, the control signal generator 322 counts the horizontal back porch interval HBP corresponding to the first value HBPV from the first point in time T1 or the fourth point in time T4 and changes the gating control signal CTRL from the high level to the low level before the data enable signal DE changes from the low level to the high level when it is determined that a counted time is greater than the horizontal back porch interval HBP.

The clock gating circuit 324 resumes toggling of the first clock signal CLK1 in response to the gating control signal CTRL of the low level to transmit the second clock signal CLK2 toggling between the high level and the low level to the first output terminal 324-3. As the gating control signal CTRL changes to the low level, the clock gating circuit 324 may output a second clock signal CLK2 that toggles (toggling may be also referred to as oscillating).

The control signal generator 322 changes the gating control signal CTRL from the low level to the high level when changing the data enable signal DE from the high level to the low level at a point in time T2 or a point in time T5.

As shown in FIG. 3, the control signal generator 322 changes the gating control signal CTRL from the low level to the high level a certain time after the data enable signal DE changes from the high level to the low level (e.g., after the first clock signal CLK1 or the second clock signal CLK2 is toggled again for a period time). This is to secure a data processing margin.

The clock gating circuit 324 stops the toggling of the first clock signal CLK1 in response to the gating control signal CTRL of the high level to transmit the second clock signal CLK2 maintained at the low level to the first output terminal 324-3. Therefore, the second clock signal CLK2 output from the clock gating circuit 324 is maintained at the low level, thereby reducing power consumption caused by toggling of the second clock signal CLK2.

At a third point in time T3 or a sixth point in time T6, when it is determined that the data enable signal DE is a last data enable signal DE in a corresponding frame, the control signal generator 322 maintains the gating control signal CTRL at the high level during vertical front porch intervals VFP_1 and VFP_2 corresponding to the second value VFPV after the last data enable signal DE changes from the high level to the low level (or a certain time after the last data enable signal DE changes from the high level to the low level). In this case, the second value VFPV may be set differently according to a first frame rate or a second frame rate.

Accordingly, the second clock signal CLK2 of the low level is output through the first output terminal 324-3 during the vertical front porch intervals VFP_1 and VFP_2.

In the present disclosure, the reason why the gating control signal is maintained at the high level during each of the vertical front porch intervals VFP_1 and VFP_2 is following. Because the vertical front porch intervals VFP_1 and VFP_2 are set to be longer than other intervals of time during which the data enable signal DE in one frame is not output, the gating control signal CTRL may be prevented from changing to the low level again to continuously stop the toggling of the second clock signal CLK2 by maintaining the gating control signal at the high level during the vertical front porch intervals VFP_1 and VFP_2, thereby greatly reducing power consumption.

In an embodiment, the control signal generator 322 may determine, as a point in time when a last data enable signal DE in a corresponding frame ends, a point in time after the sum of the third value VBPV representing the vertical back porch interval VBP and the fourth value VACV representing the vertical active interval V_active is counted after a rising edge of the vertical synchronization signal Vsync is detected. In this case, the third value VBPV and the fourth value VACV may be set differently according to a first frame rate or a second frame rate.

Referring back to FIG. 2, the data processing logic circuit 326 includes a second input terminal 326-2 for receiving data DATA and a clock input terminal 326-1 electrically connected to the first output terminal 324-3 of the clock gating circuit 324. The data processing logic circuit 326 processes data DATA in response to the second clock signal CLK2 and transmits the processed data to the timing controller 330.

The control circuit 320 includes a bypass line 328 electrically connected between the first input terminal 324-2 of the clock gating circuit 324 and a second pad PD2. The bypass line 328 provides the first clock signal CLK1, which continuously toggles, to a gate-in-panel (GIP) controller 334 through the second pad PD2. Accordingly, the first clock signal CLK1 that continuously toggles even during a vertical front porch interval VFP of each frame is output to the GIP controller 334.

The timing controller 330 includes a first pad PD1 electrically connected to the first output terminal 324-3 of the clock gating circuit 324 and the second pad PD2 electrically connected to the bypass line 328.

The timing controller 330 includes a source driver 332 and the GIP controller 334.

The source driver 332 transmits data processed by the data processing logic circuit 326 to the display device 400 through the data driving circuit 340 in response to the second clock signal CLK2 input through the first pad PD1.

The source driver 332 does not directly drive the data lines 420 arranged on the display device 400 but transmits data DATA transmitted from the host system 200 to the data driving circuit 340 in response to (or in synchronization with) the second clock signal CLK2. The data driving circuit 340 actually drives the data lines 420 arranged on the display device 400.

There are intervals of time during which the second clock signal CLK2 supplied to the data processing logic circuit 326 and the source driver 332 does not toggle according to a gating control signal and thus power consumption of each of the data processing logic circuit 326 and the source driver 332 may decrease.

The GIP controller 334 includes a gate control circuit 336, and the gate control circuit 336 transmits gate pulses to the display device 400 in response to the first clock signal CLK1 input via the second pad PD2. The gate control circuit 336 does not directly drive the gate lines 430 arranged on the display device 400 but transmits the gate pulses to the gate driving circuit 440 in response to (or in synchronization with) the first clock signal CLK1. The gate driving circuit 440 actually drives the gate lines 430 arranged on the display device 400 in response to the gate pulses The GIP controller 334 may further include an emission control circuit 338 that controls emission of light from light-emitting elements included in the display device 400 in response to the first clock signal CLK1 input through the second pad PD2. For example, the gate control circuit 336 supplies current to each of the light-emitting elements, and the emission control circuit 338 controls emission of light from each of the light-emitting elements.

Although it is described in the above-described embodiment that the GIP controller 334 is operated according to the first clock signal CLK1, in another embodiment, the GIP controller 334 may be operated according to the second clock signal CLK2.

In this case, because the GIP controller 334 is supplied with the second clock signal CLK2 that does not toggle for some intervals of time according to a gating control signal, power consumption of the GIP controller 334 and the gate driving circuit 440 may additionally decrease.

In an embodiment, the control circuit 320 may control gating of the first clock signal CLK1 (e.g., stopping and resuming toggling thereof) during the vertical front porch interval VFP of the vertical synchronization signal Vsync regardless of a command APC transmitted from the host system 200 and indicating a frequency corresponding to a frame rate of the display device 400.

For example, as shown in FIG. 3, a vertical front porch interval VFP_2 of the vertical synchronization signal Vsync when the display device 400 is operated at a first frame rate (e.g., 60 Hz) is set to be longer than a vertical front porch interval VFP_1 of the vertical synchronization signal Vsync when the display device 400 is operated at a second frame rate (e.g., 120 Hz), and the vertical front porch interval VFP_1 of the vertical synchronization signal Vsync when the display device 400 is operated at the second frame rate is set to be short. The control signal generator 322 generates the gating control signal CTRL of the high level during the vertical front porch intervals VFP_1 and VFP_2 of the vertical synchronization signal Vsync regardless of a frame rate of the display device 400.

Accordingly, the clock gating circuit 324 generates the second clock signal CLK2 that does not toggle during the vertical front porch intervals VFP_1 and VFP_2 of the vertical synchronization signal Vsync in response to the gating control signal CTRL of the high level, thereby minimizing power consumption.

In another embodiment, the control circuit 320 may generate the gating control signal CTRL of the high level during the vertical front porch interval VFP_2 of the vertical synchronization signal Vsync only when a command APC instructing to operate the display device 400 at the first frame rate is received, thereby generating the second clock signal CLK2 that does not toggle during the vertical front porch interval VFP_2.

According to the other embodiment, when the command APC instructing to operate the display device 400 at the second frame rate is received, the control circuit 320 may output the second clock signal CLK2 or the first clock signal CLK1 that toggles even during the vertical front porch interval VFP_1 of the vertical synchronization signal Vsync.

In the above embodiment, the gating control signal CTRL of the high level is generated during the vertical front porch interval VFP_2 only when the command APC instructing to operate the display device 400 at the first frame rate is received, because the vertical front porch interval VFP_2 when the display device 400 is operated at the first frame rate is set to be longer than when the display device 400 is operated at the second frame rate and thus a power consumption rate when the display device 400 is operated at the first frame rate may be greater than that when the display device 400 is operated at the second frame rate.

According to the present disclosure, power consumption caused by togging a clock signal can be reduced by gating the clock signal during a vertical front porch interval of each of different frame rates.

It should be understood by those skilled in the art that the present disclosure can be embodied in other specific forms without changing the technical concept and essential features of the present disclosure.

All disclosed methods and procedures described herein may be implemented, at least in part, using one or more computer programs or components. These components may be provided as a series of computer instructions through any conventional computer-readable medium or machine-readable medium including volatile and nonvolatile memories such as random-access memories (RAMs), read only-memories (ROMs), flash memories, magnetic or optical disks, optical memories, or other storage media. The instructions may be provided as software or firmware, and may, in whole or in part, be implemented in a hardware configuration such as application-specific integrated circuits (ASICs), field-programmable gate arrays (FPGAs), digital signal processors (DSPs), or any other similar device. The instructions may be configured to be executed by one or more processors or other hardware configurations, and the processors or other hardware configurations are allowed to perform all or part of the methods and procedures disclosed herein when executing the series of computer instructions.

Therefore, the above-described embodiments should be understood to be exemplary and not limiting in every aspect. The scope of the present disclosure will be defined by the following claims rather than the above-detailed description, and all changes and modifications derived from the meaning and the scope of the claims and equivalents thereof should be understood as being included in the scope of the present disclosure.

What is claimed is:

1. An integrated circuit for gating a clock signal, comprising:

a control signal generator configured to change a gating control signal from a low level to a high level according to a timing when a data enable signal changes from the high level to the low level, and change the gating control signal from the high level to the low level after a predetermined horizontal back porch interval from a rising edge of a horizontal synchronization signal; and a clock gating circuit configured to stop toggling of a first clock signal input through a first input terminal to output a second clock signal maintained at the low level through a first output terminal when the gating control signal of the high level is input to a control terminal, and resume the toggling of the first clock signal to output the second clock signal, which toggles between the high level and the low level, through the first output terminal when the gating control signal of the low level is input to the control terminal.

2. The integrated circuit of claim 1, wherein the control signal generator maintains the gating control signal at the high level during a predetermined vertical front porch interval from a falling edge of a last data enable signal among data enable signals in one frame.

3. The integrated circuit of claim 2, wherein the control signal generator receives, from a host system, a first command instructing to operate a display device at a first frame rate or a second command instructing to operate the display device at a second frame rate higher than the first frame rate, and generates the gating control signal of the high level when the first command is received from the host system.

4. The integrated circuit of claim 3, wherein the vertical front porch interval is set differently according to the first frame rate or the second frame rate.

5. The integrated circuit of claim 1, wherein the control signal generator changes the gating control signal from the high level to the low level before the data enable signal changes from the low level to the high level.

6. The integrated circuit of claim 1, further comprising:

a data processing logic circuit including a clock input terminal connected to the first output terminal of the clock gating circuit and a second input terminal for receiving data;

a bypass line connected to the first input terminal of the clock gating circuit and configured to bypass the first clock signal; and a timing controller including a first pad connected to the first output terminal of the clock gating circuit and a second pad connected to the bypass line.

7. The integrated circuit of claim 6, wherein the timing controller comprises:

a source driver configured to transmit data processed by the data processing logic circuit to a display device through a data driving circuit in response to the second clock signal input through the first pad; and a gate control circuit configured to transmit gate pulses to the display device in response to the first clock signal input through the second pad.

8. The integrated circuit of claim 1, wherein the control signal generator changes the gating control signal from the low level to the high level in synchronization with a timing when the data enable signal changes from the high level to the low level or a predetermined time after the data enable signal changes from the high level to the low level.

9. A display system comprising:

a display device configured to be operated at a first frame rate or a second frame rate higher than the first frame rate; and a driver integrated circuit (IC) configured to control an operation of the display device, wherein the driver IC comprises:

a control signal generator configured to change a gating control signal from a low level to a high level according to a timing when a data enable signal changes from the high level to the low level, and change the gating control signal from the high level to the low level after a predetermined horizontal back porch interval from a rising edge of a horizontal synchronization signal; and a clock gating circuit configured to stop toggling of a first clock signal input through a first input terminal to output a second clock signal maintained at the low level through a first output terminal when the gating control signal of the high level is input to a control terminal, and resume the toggling of the first clock signal to output the second clock signal, which toggles between the high level and the low level, through the first output terminal when the gating control signal of the low level is input to the control terminal.

10. The display system of claim 9, wherein the control signal generator changes the gating control signal from the high level to the low level after the horizontal back porch interval from a rising edge of the horizontal synchronization signal elapses and before the data enable signal changes from the low level to the high level.

11. The display system of claim 9, wherein the control signal generator changes the gating control signal from the low level to the high level in synchronization with a timing when the data enable signal changes from the high level to the low level or a predetermined time after the data enable signal changes from the high level to the low level.

12. The display system of claim 9, wherein the control signal generator maintains the gating control signal at the high level during a predetermined vertical front porch interval from a falling edge of a last data enable signal among data enable signals in one frame.

13. The display system of claim 12, wherein the vertical front porch interval is set differently according to the first frame rate or the second frame rate.

14. The display system of claim 9, wherein the control signal generator receives, from a host system, a first command instructing to operate the display device at the first frame rate or a second command instructing to operate the display device at the second frame rate, and generates the gating control signal of the high level when the first command is received from the host system.

15. The display system of claim 9, wherein the driver IC comprises:

a data processing logic circuit including a clock input terminal connected to the first output terminal of the clock gating circuit and a second input terminal for receiving data;

a bypass line connected to the first input terminal of the clock gating circuit and configured to bypass the first clock signal;

a source driver configured to transmit data processed by the data processing logic circuit to the display device through a data driving circuit in response to the second clock output from the first output terminal of the clock gating circuit; and a gate control circuit configured to transmit gate pulses to the display device in response to the first clock signal input through the bypass line.

16. An operation method of an integrated circuit for gating a clock signal, comprising:

changing a gating control signal from a low level to a high level when a data enable signal changes from the high level to the low level;

stopping toggling of a first clock signal input through a first input terminal to output a second clock signal maintained at the low level to a first output terminal in response to the gating control signal of the high level;

changing the gating control signal from the high level to the low level after a predetermined horizontal back porch interval from a rising edge of a horizontal synchronization signal; and resuming the toggling of the first clock signal to output the second clock signal, which toggles between the high level and the low level, to the first output terminal in response to the gating control signal of the low level.

17. The operation method of claim 16, wherein, in the step of changing the gating control signal from the low level to the high level, the gating control signal is maintained at the high level during a predetermined vertical front porch interval from a falling edge of a last data enable signal among data enable signals in one frame.

18. The operation method of claim 16, wherein the step of changing the gating control signal from the low level to the high level comprises receiving, from a host system, a first command instructing to operate a display device at a first frame rate or a second command instructing to operate the display device at a second frame rate higher than the first frame rate, and wherein the gating control signal is changed from the low level to the high level when the first command is received from the host system.

19. The operation method of claim 16, wherein, in the step of changing the gating control signal from the high level to the low level, the gating control signal is changed from the high level to the low level after the horizontal back porch interval from a rising edge of the horizontal synchronization signal elapses and before the data enable signal changes from the low level to the high level.

* * * * *